US011466675B2

(12) United States Patent
Cain

(10) Patent No.: US 11,466,675 B2
(45) Date of Patent: Oct. 11, 2022

(54) AIR COMPRESSOR AND METHODS OF OPERATION

(71) Applicant: Eaton-Max, Inc., Clayton, OH (US)

(72) Inventor: Matthew Scott Cain, Eaton, OH (US)

(73) Assignee: Eaton-Max, Inc., Clayton, OH (US)

( * ) Notice: Subject to any disclaimer, the term of this patent is extended or adjusted under 35 U.S.C. 154(b) by 728 days.

(21) Appl. No.: 16/290,034

(22) Filed: Mar. 1, 2019

(65) Prior Publication Data

US 2019/0277276 A1 Sep. 12, 2019

Related U.S. Application Data

(63) Continuation-in-part of application No. 15/473,730, filed on Mar. 30, 2017, now Pat. No. 10,578,089.

(51) Int. Cl.

| | |
|---|---|
| ***F04B 49/06*** | (2006.01) |
| ***F04B 41/02*** | (2006.01) |
| ***F04B 35/04*** | (2006.01) |
| ***F04B 49/03*** | (2006.01) |
| ***F04B 49/20*** | (2006.01) |
| ***F04B 35/06*** | (2006.01) |

(52) U.S. Cl.

CPC ..... *F04B 49/06* (2013.01); *F04B 35/04* (2013.01); *F04B 41/02* (2013.01); *F04B 49/03* (2013.01); *F04B 49/065* (2013.01); *F04B 49/20* (2013.01); *F04B 35/06* (2013.01)

(58) Field of Classification Search

CPC ..... F04B 49/06; F04B 49/03; F04B 49/065; F04B 35/04; F04B 35/06; F04B 491/02; F04B 49/20

See application file for complete search history.

(56) References Cited

U.S. PATENT DOCUMENTS

| | | | | |
|---|---|---|---|---|
| 2,510,887 A | | 6/1950 | Hanson | |
| 4,264,282 A | | 4/1981 | Crago | |
| 5,118,262 A | | 6/1992 | Kuo | |
| 5,332,872 A | | 7/1994 | Ewanek | |
| 5,402,053 A | * | 3/1995 | Divan | H02M 5/14 318/768 |

(Continued)

FOREIGN PATENT DOCUMENTS

| | | | |
|---|---|---|---|
| CN | 103696967 A | * | 4/2014 |
| CN | 107893768 A | | 4/2018 |

(Continued)

OTHER PUBLICATIONS

Eaton-Max, Inc., The Power of Innovation: New energy saving single phase variable speed piston!, Apr. 2017, 1 page.

(Continued)

*Primary Examiner* — Forrest M Phillips

(74) *Attorney, Agent, or Firm* — Barnes.& Thornburg LLP

(57) ABSTRACT

A reciprocating piston air compressor includes a programmable logic controller, a tank, a motor, a pump, a variable speed drive, a head unloader and a cooling system. The programmable logic controller and/or variable speed drive are utilized to monitor the operating state of the air compressor and to control various operational variables, such as motor and pump speed. The air compressor can utilize the variable speed drive to operate a three phase motor on single-phase power.

13 Claims, 13 Drawing Sheets

(56) References Cited

U.S. PATENT DOCUMENTS

| | | | | |
|---|---|---|---|---|
| 5,820,352 | A * | 10/1998 | Gunn | F04B 39/16 417/53 |
| 6,049,188 | A * | 4/2000 | Smith | H02P 1/265 318/781 |
| 6,375,437 | B1 | 4/2002 | Nolan | |
| 6,629,825 | B2 | 10/2003 | Stickland et al. | |
| 6,790,012 | B2 | 9/2004 | Sharp et al. | |
| 7,017,342 | B2 | 3/2006 | Iimura et al. | |
| 7,086,841 | B2 | 8/2006 | Cornwell | |
| 7,431,127 | B2 | 10/2008 | de Borchgrave et al. | |
| 7,476,088 | B2 | 1/2009 | Iimura et al. | |
| 7,481,627 | B2 | 1/2009 | Beckman | |
| 7,641,449 | B2 | 1/2010 | Iimura et al. | |
| 7,704,052 | B2 | 4/2010 | Iimura et al. | |
| 8,117,960 | B2 | 2/2012 | Hartl et al. | |
| 8,282,363 | B2 | 10/2012 | Ohi et al. | |
| 8,467,950 | B1 * | 6/2013 | Pfefferl | B60T 17/02 701/100 |
| 8,579,600 | B2 | 11/2013 | Vijayakumar | |
| 8,714,947 | B2 | 5/2014 | Asai | |
| 8,784,070 | B2 | 7/2014 | Yokota et al. | |
| 8,821,131 | B2 | 9/2014 | Yokota et al. | |
| 8,967,324 | B2 | 3/2015 | White et al. | |
| 9,353,739 | B2 | 5/2016 | Wilson et al. | |
| 9,435,329 | B2 | 9/2016 | Kitagawa et al. | |
| 9,476,421 | B2 | 10/2016 | Cesak et al. | |
| 9,518,587 | B2 | 12/2016 | Yokota et al. | |
| 9,528,506 | B2 | 12/2016 | Koshida et al. | |
| 9,903,358 | B2 | 2/2018 | Hernandez et al. | |
| 9,982,665 | B2 | 5/2018 | Ichihashi | |
| 11,136,870 | B2 * | 10/2021 | Broussard | F04B 17/03 |
| 2002/0027041 | A1 | 3/2002 | Czabala et al. | |
| 2006/0045751 | A1 * | 3/2006 | Beckman | F04B 49/022 417/44.2 |
| 2006/0144637 | A1 * | 7/2006 | Swartz | F04B 39/0038 181/198 |
| 2006/0193728 | A1 * | 8/2006 | Lindsey | F04B 49/03 417/1 |
| 2010/0303658 | A1 | 12/2010 | Ito et al. | |
| 2013/0062141 | A1 | 3/2013 | Wood et al. | |
| 2017/0037844 | A1 | 2/2017 | Takeuchi et al. | |
| 2017/0184087 | A1 | 6/2017 | Bock et al. | |
| 2018/0003122 | A1 * | 1/2018 | Burkell | F02D 41/221 |
| 2018/0017062 | A1 | 1/2018 | Peters et al. | |
| 2018/0119687 | A1 | 5/2018 | Asai | |
| 2018/0223832 | A1 * | 8/2018 | Ren | F04B 49/20 |
| 2018/0230983 | A1 | 8/2018 | Wood et al. | |

FOREIGN PATENT DOCUMENTS

| | | | |
|---|---|---|---|
| DE | 102020108654 | A1 * | 9/2021 |
| EP | 1191225 | A2 | 3/2002 |
| EP | 1191225 | A3 | 6/2003 |
| EP | 2006541 | A2 | 12/2008 |
| GB | 653515 | | 5/1951 |

OTHER PUBLICATIONS

Eaton-Max, Inc., Coming in Q4 2017: 25HP Variable Speed Single Phase Piston Air Compressor with Silent Air & PLC Smart Technology, Apr. 2017, 5 pages.

* cited by examiner

AIR COMPRESSOR AND METHODS OF OPERATION

This application is a continuation-in-part of U.S. patent application Ser. No. 15/473,730 filed Mar. 30, 2017. The present invention relates to air compressors and, more particularly, to a reciprocating piston type air compressor and methods of operating such an air compressor.

BACKGROUND OF THE INVENTION

An air compressor is a device that converts air, typically at atmospheric pressure, to pressurized air and stores it in a storage tank for use in various applications. For example, the pressurized air can be used to inflate tires, operate pressurized air driven tools and for other purposes. By one of several methods, an air compressor forces more and more air into the storage tank, increasing the pressure. In certain prior art air compressors, the compressor shuts off when tank pressure reaches a specified limit. The compressed air, then, is held in the tank until called into use. Two common types of air compressors are reciprocating piston compressors and rotary screw compressors. One example of a prior art reciprocating piston compressor is shown in U.S. Pat. No. 7,086,841.

SUMMARY OF THE INVENTION

In one embodiment of the present invention, a reciprocating piston air compressor includes a tank for storing compressed air, a reciprocating piston pump for compressing air and delivering it to the tank, an electric motor for driving the pump, an outlet for delivering compressed air from the tank for use external to the tank, and a programmable logic controller for controlling operation of the air compressor.

In one embodiment, the reciprocating piston air compressor also includes a variable speed drive for operating the electric motor. In another embodiment, the electric motor is a three-phase motor and the variable speed drive operates the electric motor on both single-phase and three-phase power. In certain embodiments, the horse power rating of the variable speed drive exceeds the horse power rating of the electric motor.

In other embodiments, the pump includes an air intake, an air intake valve and a head unloader that maintains the air intake valve in the open position during startup of the electric motor. In one embodiment, the head unloader includes a plunger for maintaining the air intake valve in the open position and an air cylinder for activating the plunger. In another embodiment, the reciprocating piston air compressor further includes a fitting communicating with the tank, a solenoid connected to the fitting, the solenoid having an open position and a closed position, and tubing connected at one end to the solenoid and at another end to the head unloader to communicate air from the tank to the air cylinder to activate the air cylinder and depress the plunger when the solenoid is in the open position.

According to another embodiment, the reciprocating piston air compressor further includes an aftercooler for cooling the compressed air after it exits the pump and before it enters the tank. The aftercooler may include a radiator and a fan.

In another embodiment, the reciprocating piston air compressor further includes a cooling system. The cooling system includes a plurality of cylinder heads having channels therein through which a cooling fluid circulates, and a radiator. The radiator has a first section through which cooling water circulates and a second section through which compressed air circulates after exiting the pump and before entering the tank. In one embodiment, the cooling system further includes a plurality of ports in the cylinder heads and a plurality of hoses for circulating the cooling fluid from one cylinder head to another cylinder head.

One embodiment of the present invention is a method of operating a reciprocating piston air compressor having a tank for storing compressed air, a reciprocating piston pump for compressing air and delivering it to the tank, an electric motor for driving the pump, an outlet for delivering compressed air from the tank for use external to the tank, and a programmable logic controller for controlling operation of the air compressor. The method includes the steps of determining the level of air pressurization needed for a particular application, utilizing the programmable logic controller to input an operating pressure range having a minimum operating pressure below the determined level and a maximum operating pressure at or above the determined level, starting the electric motor, and monitoring the level of air pressurization in the tank.

In another embodiment, the reciprocating piston air compressor further includes a variable speed drive, and the method includes the steps of utilizing the programmable logic controller to input a buffer pressure that is lower than the maximum operating pressure, utilizing the variable speed drive to increase the operating speed of the electric motor when the level of air pressurization in the tank reaches the buffer pressure, and for each 1 psi of air pressurization level in the tank above the buffer pressure, decreasing the speed of the motor until the pressurization level in the tank reaches the maximum operating pressure.

One embodiment of the present invention is a method of operating a reciprocating piston air compressor having a tank for storing compressed air, a reciprocating piston pump for compressing air and delivering it to the tank, an electric motor for driving the pump, an outlet for delivering compressed air from the tank for use external to the tank, a variable speed drive, and a programmable logic controller for controlling operation of the air compressor. The method includes the steps of utilizing the programmable logic controller to input an operating pressure range having a minimum operating pressure and a maximum operating pressure, utilizing the programmable logic controller to input a buffer pressure that is less than the maximum operating pressure, monitoring the pressure in the tank, and utilizing the variable speed drive to decrease the speed of the electric motor when the pressure in the tank reaches the buffer pressure.

In one embodiment, the method further includes the step of decreasing the speed of the electric motor for each increase in pressure of 1 psi above the buffer pressure until the pressure in the tank reaches the maximum operating pressure.

One embodiment of the present invention is a method of operating a reciprocating piston air compressor having a tank for storing compressed air, a reciprocating piston pump for compressing air and delivering it to the tank, a three-phase electric motor for driving the pump, an outlet for delivering compressed air from the tank for use external to the tank, a variable speed drive, and a programmable logic controller for controlling operation of the air compressor. The method includes the step of operating the electric motor from a single-phase power source.

In one embodiment of the invention, the power rating of the electric motor is less than the power rating of the variable speed drive.

One embodiment of the present invention is a method of operating a reciprocating piston air compressor having a tank for storing compressed air, a reciprocating piston pump for compressing air and delivering it to the tank, the pump having an air inlet and an inlet valve moveable between an open position and a closed position, an electric motor for driving the pump, an outlet for delivering compressed air from the tank for use external to the tank, a variable speed drive, a head unloader, and a programmable logic controller for controlling operation of the air compressor. The method includes the steps of utilizing the programmable logic controller to control the head unloader to hold the air intake valve in the open position during startup of the electric motor, utilizing the programmable logic controller to monitor the operating speed of the electric motor, and utilizing the programmable logic controller to cause the head unloader to close the air intake valve when the operating speed of the electric motor reaches a desired speed.

These and other features of the present invention will become apparent to those of ordinary skill in the art from the following Detailed Description of Embodiments of the Invention and the accompanying drawings.

DETAILED DESCRIPTION OF EMBODIMENTS OF THE INVENTION

Figure 1:
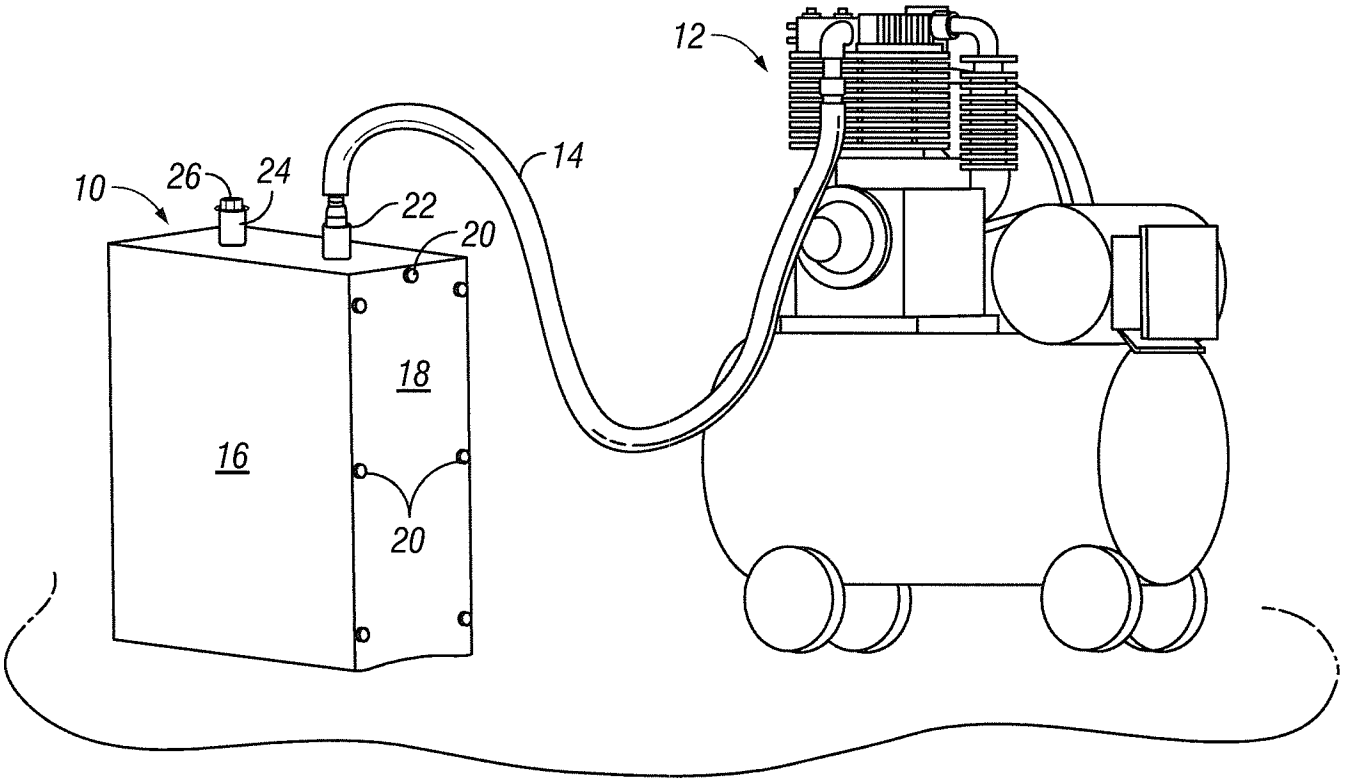
FIG. 1 is a front perspective view of an air compressor according to one embodiment of the present invention.
Figure 2:
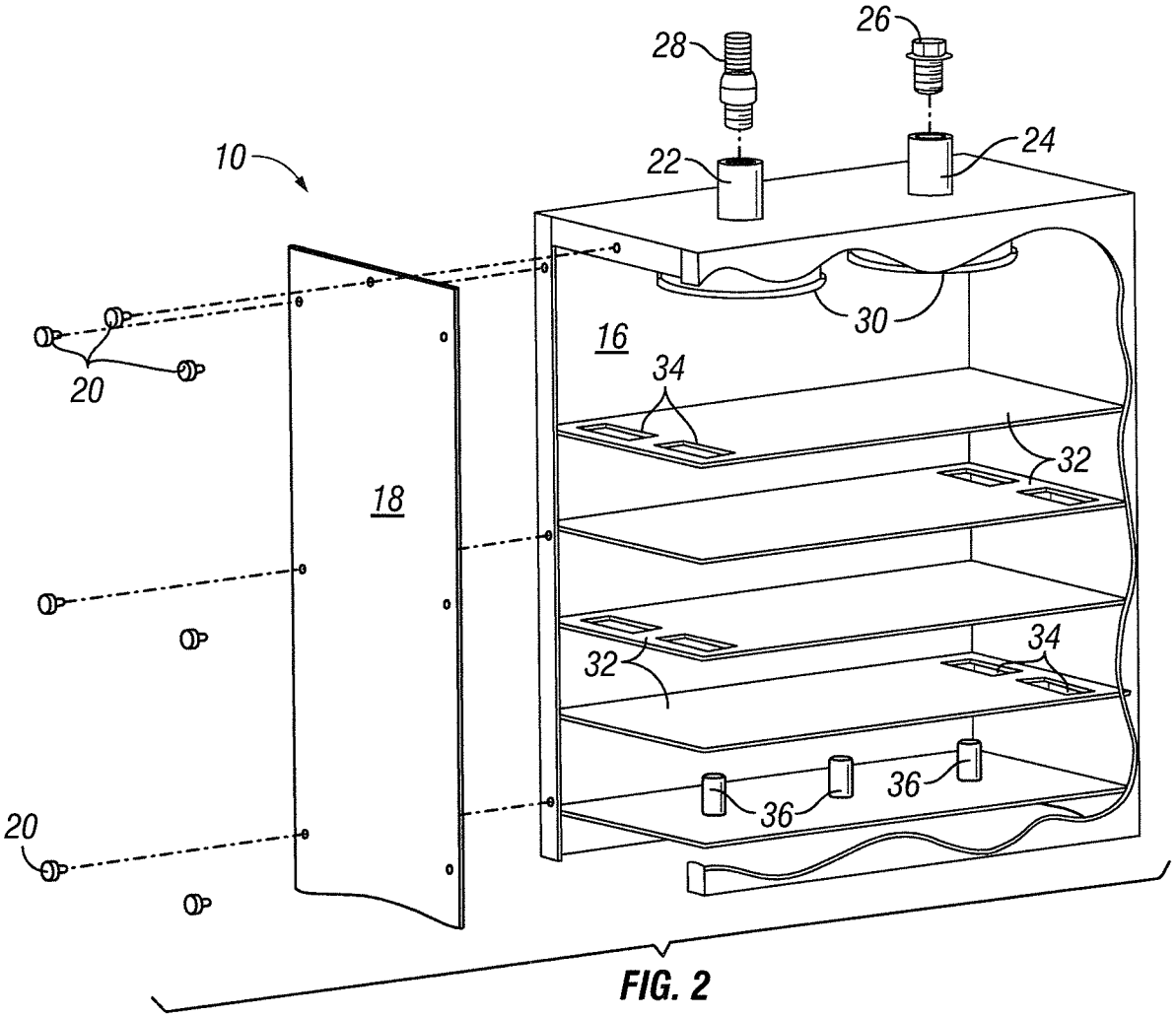
FIG. 2 is an exploded perspective view of an air compressor noise dampener that is a component of the air compressor shown in FIG. 1.
Figure 3:
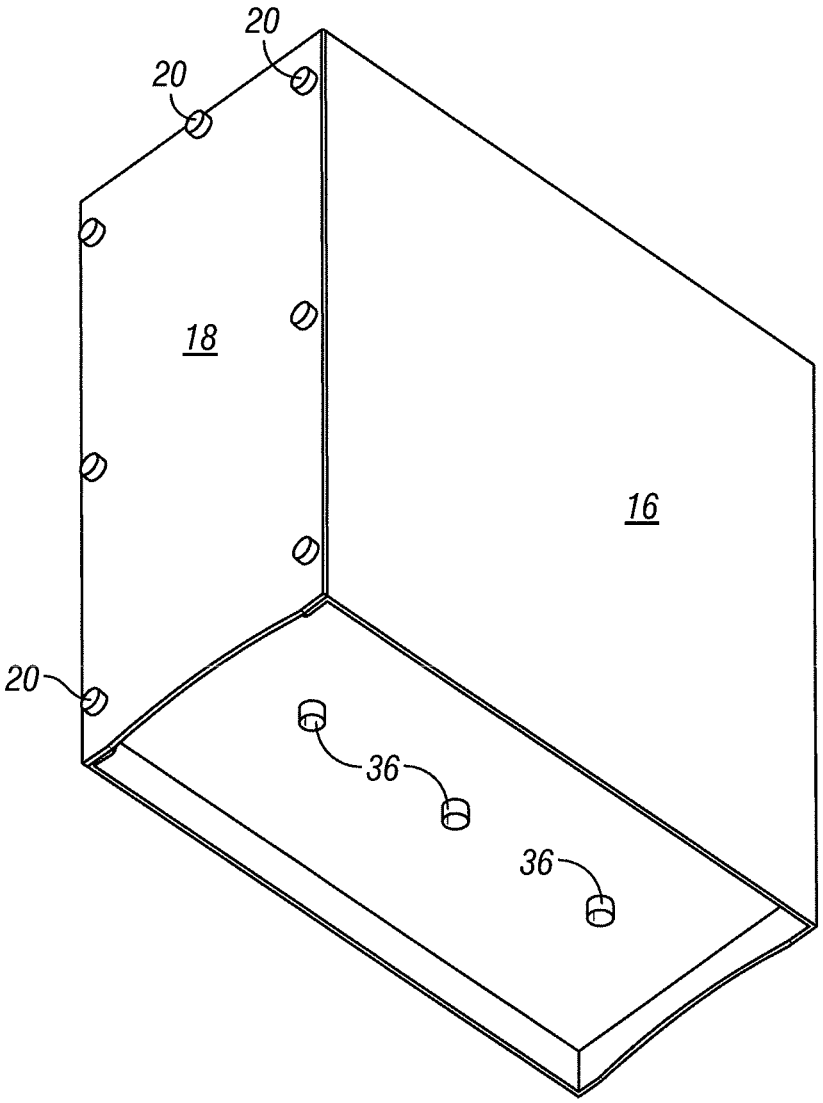
FIG. 3 is a bottom perspective view of the air compressor noise dampener shown in FIG. 2.

Referring to FIGS. 1-4, an air compressor according to one embodiment of the present invention includes an air compressor noise dampener 10. The dampener 10 includes a housing 16 having at least one inlet 36 and at least one outlet 22, 24. At least one baffle 32 is secured within the housing 16 in between the inlet 36 and the outlet 22, 24. The baffle 32 includes an opening 34 offset from the outlet 22, 24 so that sound waves entering through the outlet 22, 24 hits a portion of the baffle prior to traveling through the opening 34. The present invention further includes a tube 14, such as a rubber hose. The tube 14 fluidly connects the outlet 22, 24 with an intake of an air compressor 12.

In certain embodiments, the housing 16 includes a top wall, a bottom wall and a sidewall. The sidewall may be rounded or rectangular forming four sidewalls. One of the four sidewalls may be a front plate 18 releasably secured to the remainder of the housing 16 by a plurality of screws 20 running through aligning openings. The bottom wall may include the inlet 36 and is disposed above bottom edges of the four sidewalls. The top wall may include the outlet 22, 24. The bottom edge of at least one of the four sidewalls is recessed to allow air to pass through. The inlet 36 may include a plurality of pipes secured to the bottom wall.

Figure 4:
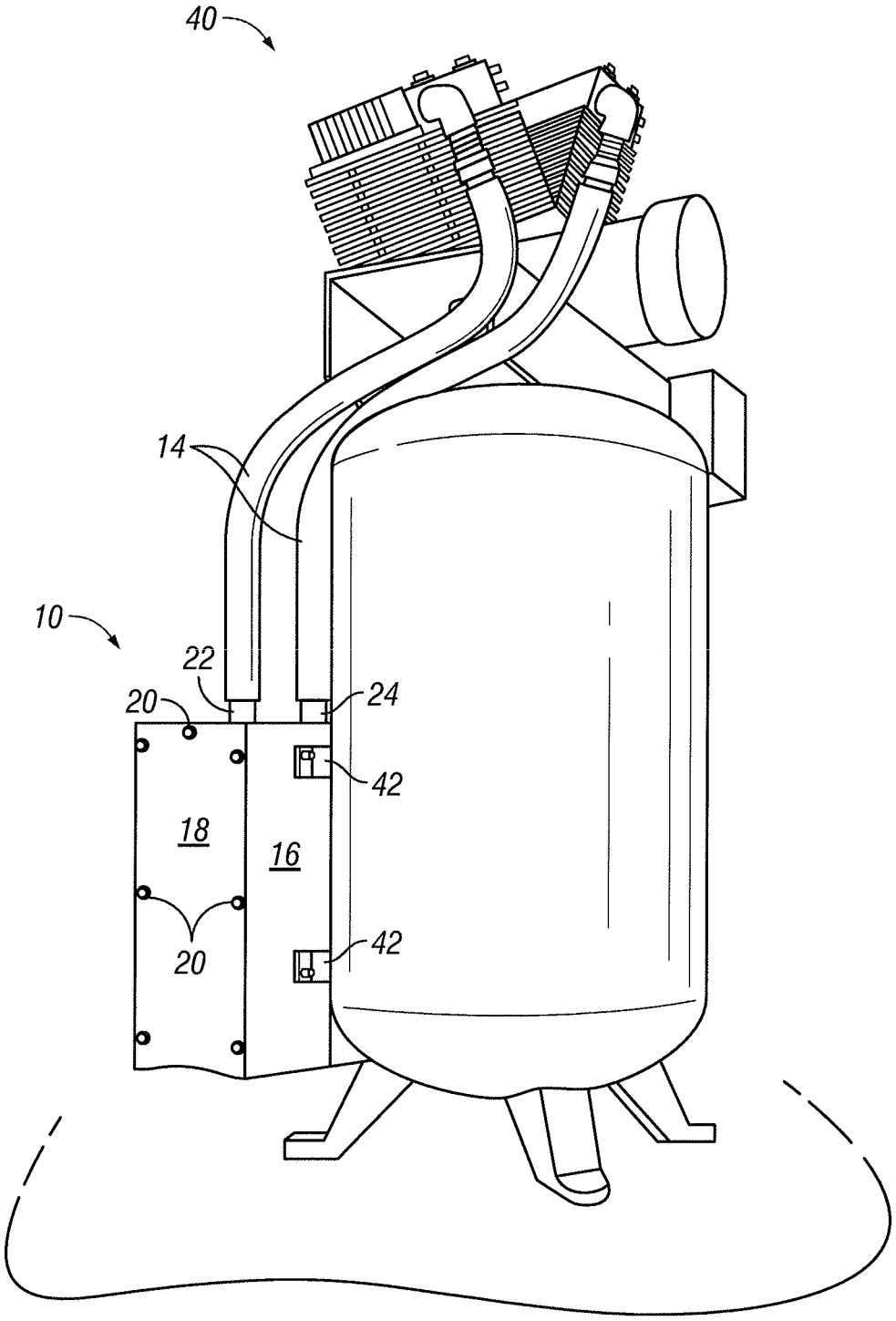
FIG. 4 is a perspective view of an air compressor according to another embodiment of the present invention.
Figure 5:
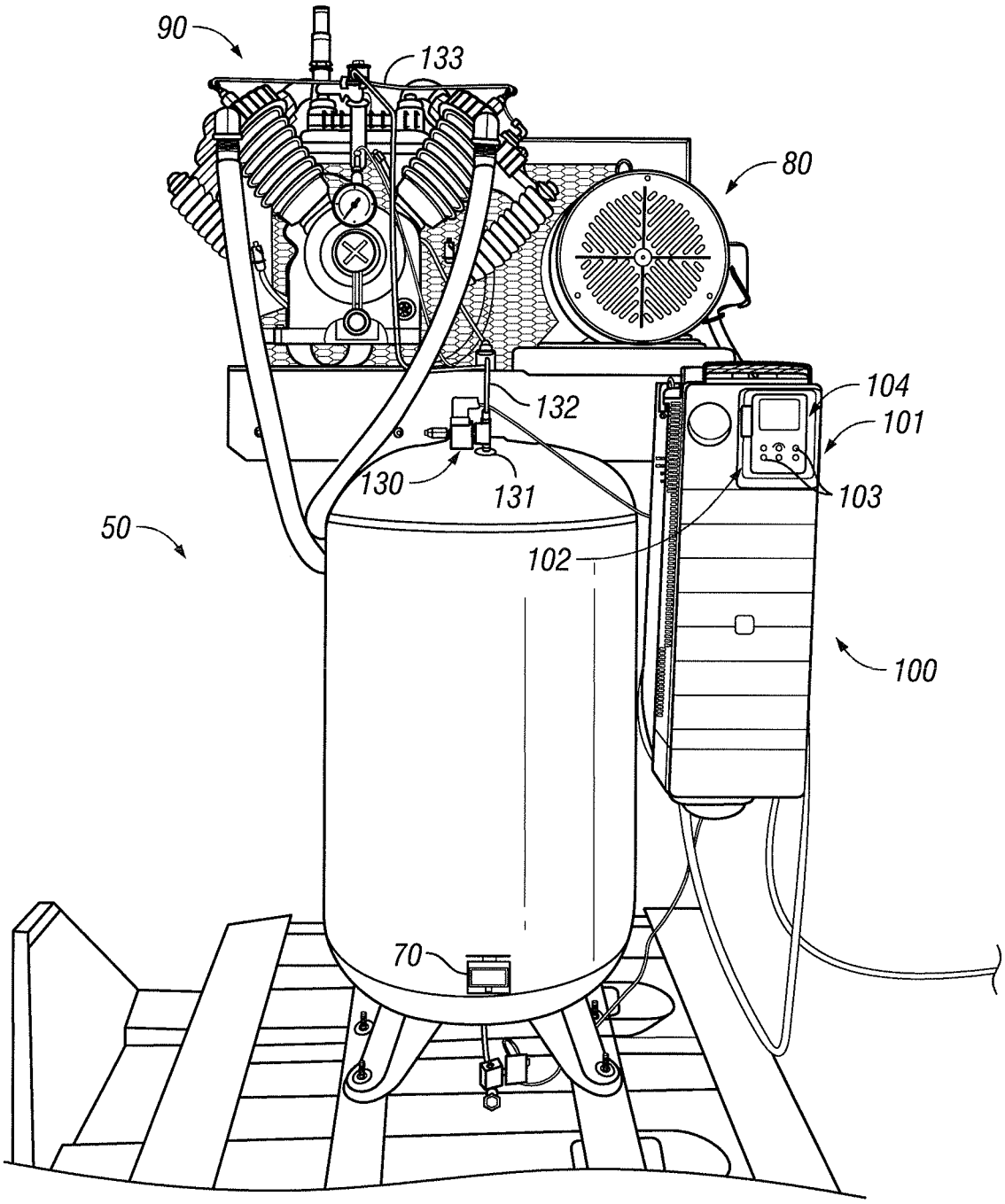
FIG. 5 is a front view of an air compressor according to another embodiment of the present invention.

The at least one outlet 22, 24 may include a first threaded port 22 and a second threaded port 24. At least one tube fitting 28 includes a male threaded connector mechanically fastened to the first threaded port 22. The first end of the tube 14 may be secured to the tube fitting 28. The present invention may further include a plug 26. The plug 26 also includes a male threaded connector which is mechanically fastened to the second threaded port 24. The plug 26 blocks the passageway of the second threaded port 24. As illustrated in FIG. 4, a compressor 40 may include two intakes. If the compressor 40 includes two intakes, the present invention may include a tube fitting 28 secured within each of the first threaded port 22 and the second threaded port 24. Two tubes 14 may connect the two tube fittings 28 to the two intakes of the compressor 40.

In certain embodiments, the present invention includes a plurality of baffles 32 disposed above and below one another. Each of the plurality of baffles 32 is a plate having a first end opposite a second end. The plurality of baffles 32 include a first baffle 32 having a first baffle opening 34 formed through the first end, a second baffle 32 having a second baffle opening 34 formed through the second end and a third baffle 32 having a third baffle opening 34 formed through the first end. The second baffle 32 is disposed in between the first baffle 32 and the third baffle 32.

In certain embodiments, the air compressor noise dampener 10 may be directly connected to the air compressor 40. As illustrated in FIG. 4, the present invention may include brackets 42. The brackets 42 are connected to an outer surface of the housing 16. The brackets 42 secure to the housing 16 directly to the air compressor 40.

In use, the first end of the tube 14 is secured to the tube fitting 28 and the second end of the tube 14 is secured to the intake of the compressor 12. The compressor 12 is turned on and draws air through the intake. The air is pushed through the recess of the sidewall, through the inlet 36, and through each of the openings 34 of the baffles 32. Sounds from the intake travels through the tube 14 and into the housing 16. The baffles 32 reduce the sound created by the intake by containing the sound waves in between the baffles 32. The sound may further be reduced by securing air filters 30 to block the passage ways of the first threaded port 22 and the second threaded port 24.

FIGS. 5-8 show an air compressor 50 according to another embodiment the present invention. In this embodiment, air compressor 50 includes a programmable logic controller 60, a tank 70 having an air compressor noise dampener 10 mounted thereto, an electric motor 80, a pump 90, and a variable speed drive 100. In one embodiment of the invention, electric motor 80 has a speed rating of 250 rpm to 800 rpm and variable speed drive 100 has a power rating of 2 horse power to 25 horse power.

In one embodiment of the present invention, operation of air compressor 50 is controlled by programmable logic controller 60. Programmable logic controller 60 is a microprocessor based controller that includes an input 61 having keys, buttons or other input means 62 and a display 63. Input means 62 can be utilized to input operating parameters for air compressor 50, such as those utilized in connection with the customized pressure operating range, variable speed, head unloader and cooling features and functions of air compressor 50 described in further detail below. Display 63 is utilized to provide a visual indication of various inputs to programmable logic controller 60 and of the operating state of air compressor 50. For example, display 63 can display the pressure in tank 70. It can also display maintenance alarms indicating that it is time to change filters, change the oil, that the oil level is low, that motor 80 is overloaded, that high or low voltage conditions exist, or that there has been a loss of phase. Programmable logic controller 60 can be programmed to automatically turn off motor 80 if these or other conditions exist. Programmable logic controller 60 can also be programmed to automatically turn on and turn off motor 80 at different times on different days of the week.

Variable speed drive 100 includes a programmable logic controller 101. Programmable logic controller 101 has an input 102 having keys, buttons or other input means 103 and a display 104. Input means 103 can be utilized to input operating parameters for air compressor 50. Display 104 is utilized to provide a visual indication of various inputs to programmable logic controller 101 and of the operating state of air compressor 50.

In one embodiment of the present invention, programmable logic controller 60 can be utilized to specify a customized operating pressure range for air compressor 50. Certain known air compressors operate within a preset pressure range. For example, the air compressor may be preset at the factory to turn the compressor pump off when the air stored in the compressor tank reaches a specified pressure, such as 175 psi. In one embodiment of air compressor 50, input means 62 of programmable logic controller 60 is utilized to input the minimum and maximum pressure parameters of the operating range of air compressor 50 for any given intended use of air compressor 50. For example, if a particular application requires air pressure of 100 psi, input means 62 can be utilized to set a minimum pressure of, for example, 70 psi and a maximum pressure of 100 psi. The maximum pressure can also be set higher than the required air pressure of 100 psi. When the compressed air in tank 70 reaches the maximum pressure as detected by a pressure sensor or transducer PS located in tank 70 (and shown schematically in FIG. 5), programmable logic controller 60 will cause motor 80 and pump 90 to turn off. In this manner, air compressor 50 does not utilize energy compressing air to 175 psi when compression to that level of pressurization is not needed.

Air compressor 50, in the embodiment shown, also includes various variable speed adjustment features to provide increased energy efficiency. For example, in one embodiment of the invention, programmable logic controller 60 and variable speed drive 100 utilize the selected operating pressure range in connection with the pressure level in tank 70 sensed by pressure sensor PS to regulate the speed of motor 80 and pump 90. Pressure sensor PS sends a corresponding signal to programmable logic controller 60. Programmable logic controller 60 utilizes the sensed air pressure in tank 70 in connection with the selected operating pressure range and a buffer pressure to signal variable speed drive 100 to increase or decrease the operational speed of motor 80 and pump 90 as needed. For example, if motor 80 operates in the range of 250-800 rpm, the selected maximum pressure is set at 100 psi, and the selected buffer pressure is set at 90 psi (i.e., 10 psi below the maximum pressure), programmable logic controller 60 and variable speed drive 100 will increase the speed of motor 80 when the sensed pressure in tank 70 drops to 90 psi and will then decrease the speed of motor 80 by 80 rpm for each 1 psi of pressure increase in tank 70 above 90 psi until the pressure in tank 70 reaches the selected maximum pressure.

Programmable logic controller 60 and variable speed drive 100 can also be used to control the speed of motor 80 at start up to increase energy efficiency. In this embodiment of the invention, programmable logic controller 60 and variable speed drive 100 gradually decrease the speed of motor 80 upon startup of air compressor 50 as the pressure in tank 70 approaches the maximum pressure of the range set through use of programmable logic controller 60, thereby reducing the starting current drawn by motor 80. For example, starting certain prior art 10 horse power, single phase air compressors without controlling the motor speed can result in peak current of approximately 270 amps immediately upon startup. In contrast, using programmable logic controller 60 and variable speed drive 100 to gradually reduce the speed of motor 80 can reduce the current drawn to at least as low as approximately 27 amps upon startup. Using the example discussed above, i.e., a motor 80 that operates in the range of 250-800 rpm, a selected maximum pressure of 100 psi, and a buffer pressure of 90 psi, programmable logic controller 60 and variable speed drive 100 will decrease the speed of motor 80 by 80 rpm when the pressure detected by pressure sensor PS in tank 70 reaches 90 psi and for each increase of 1 psi of pressure in tank 70 above 90 psi until the sensed pressure reaches 100 psi.

In one embodiment of the invention, variable speed drive 100 is utilized as a phase converter to operate a three-phase motor 80 on single phase power. This operational feature can be achieved by using a three-phase motor of a particular size with a variable frequency drive that is sized for use with a larger motor. For example, a 10 horse power, three-phase motor 80 combined with a 20 horse power variable frequency drive 100 will enable air compressor 50 to operate on single-phase electric with up to 80% reduction in energy consumption during start-up. Furthermore, air compressor 50 can still operate on three-phase power when available.

Figure 10:
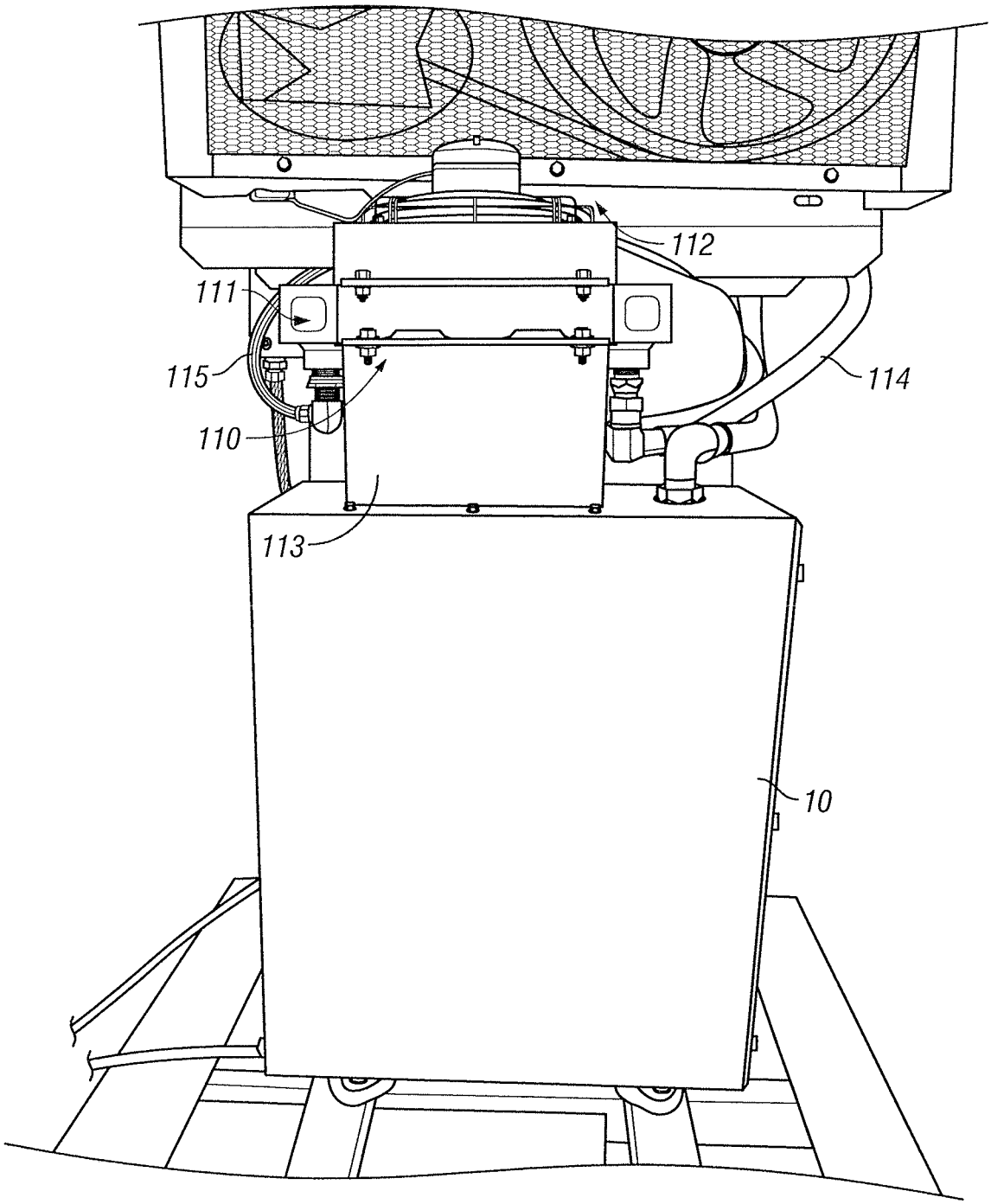
FIG. 10 is a front view of an aftercooler that is a component of an air compressor according to one embodiment of the present invention.
Figure 11:
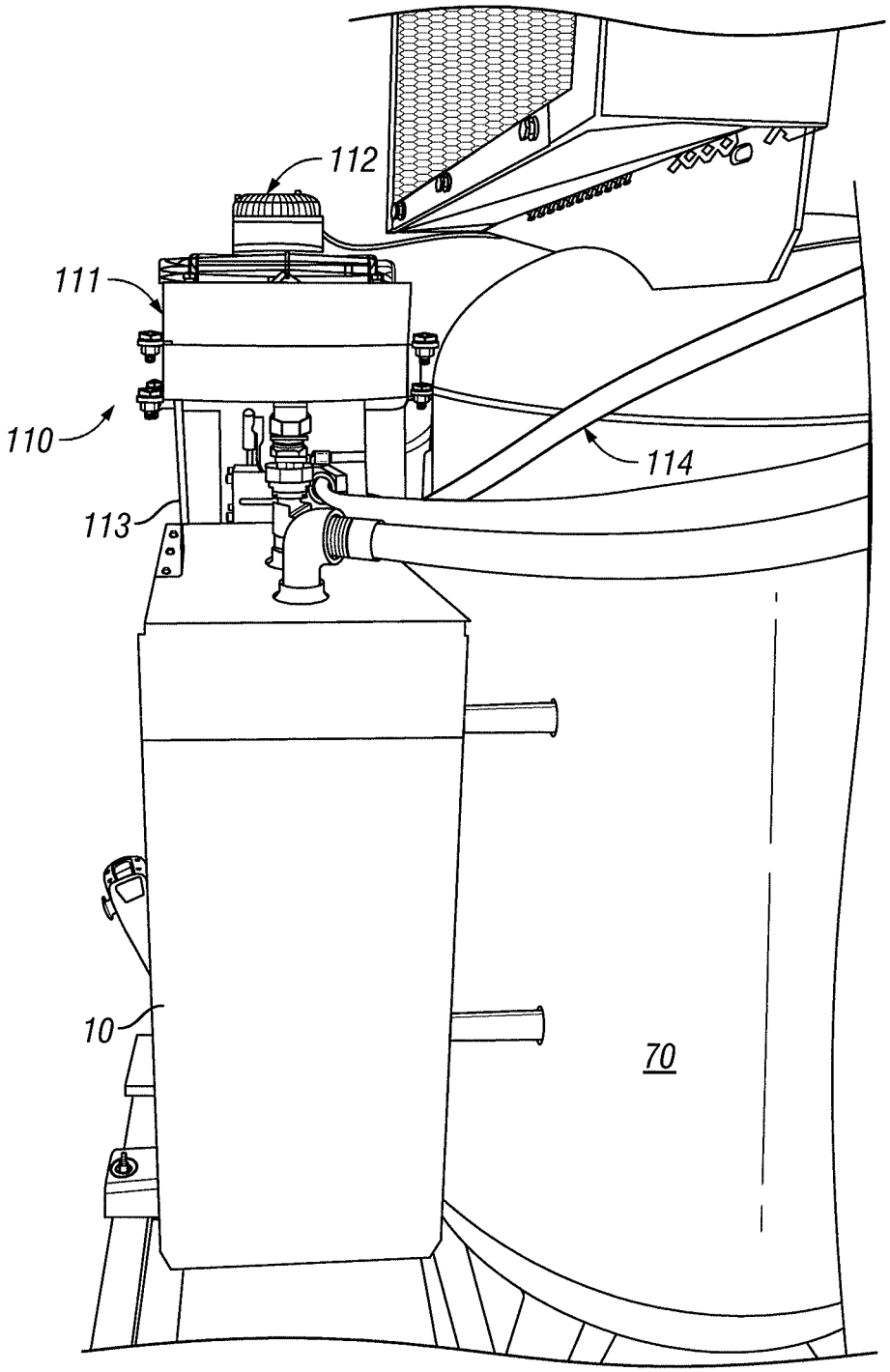
FIG. 11 is a side view of the aftercooler shown in FIG. 10.

In another embodiment of the present invention, air compressor 50 includes both an intercooler and an aftercooler 110 (FIGS. 10 and 11). As with known air compressors, the intercooler reduces the temperature of the compressed air between compression stages. Aftercooler 110 of the present invention further cools the compressed air after it leaves the pump and before it enters tank 70. In the embodiment shown in FIGS. 10 and 11, aftercooler 110 includes a radiator 111 and a fan 112. In the embodiment shown, aftercooler 110 is mounted to air compressor noise dampener 10 by a bracket 113. Upon leaving pump 90, compressed air is circulated through radiator 111 via one or more tubes 114 as fan 112 forces ambient temperature, non-compressed air over radiator 111 to cool the compressed air before it enters tank 70 through tube 115. In one embodiment of the present invention, the compressed air is cooled to a temperature approximately five degrees higher than the ambient temperature of the environment in which air compressor 50 is operating.

Figure 6:
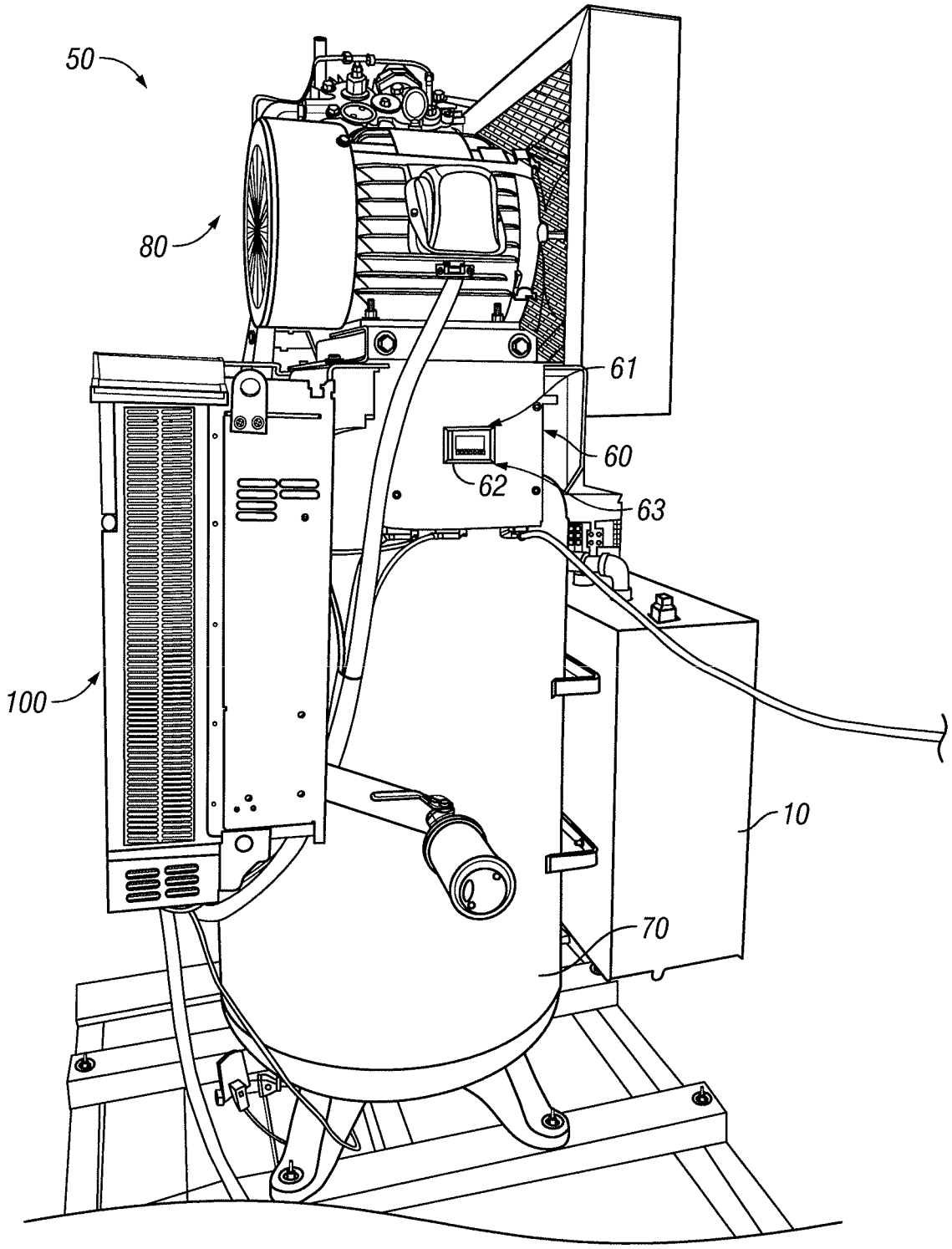
FIG. 6 is a right side view of the air compressor shown in FIG. 5.
Figure 7:
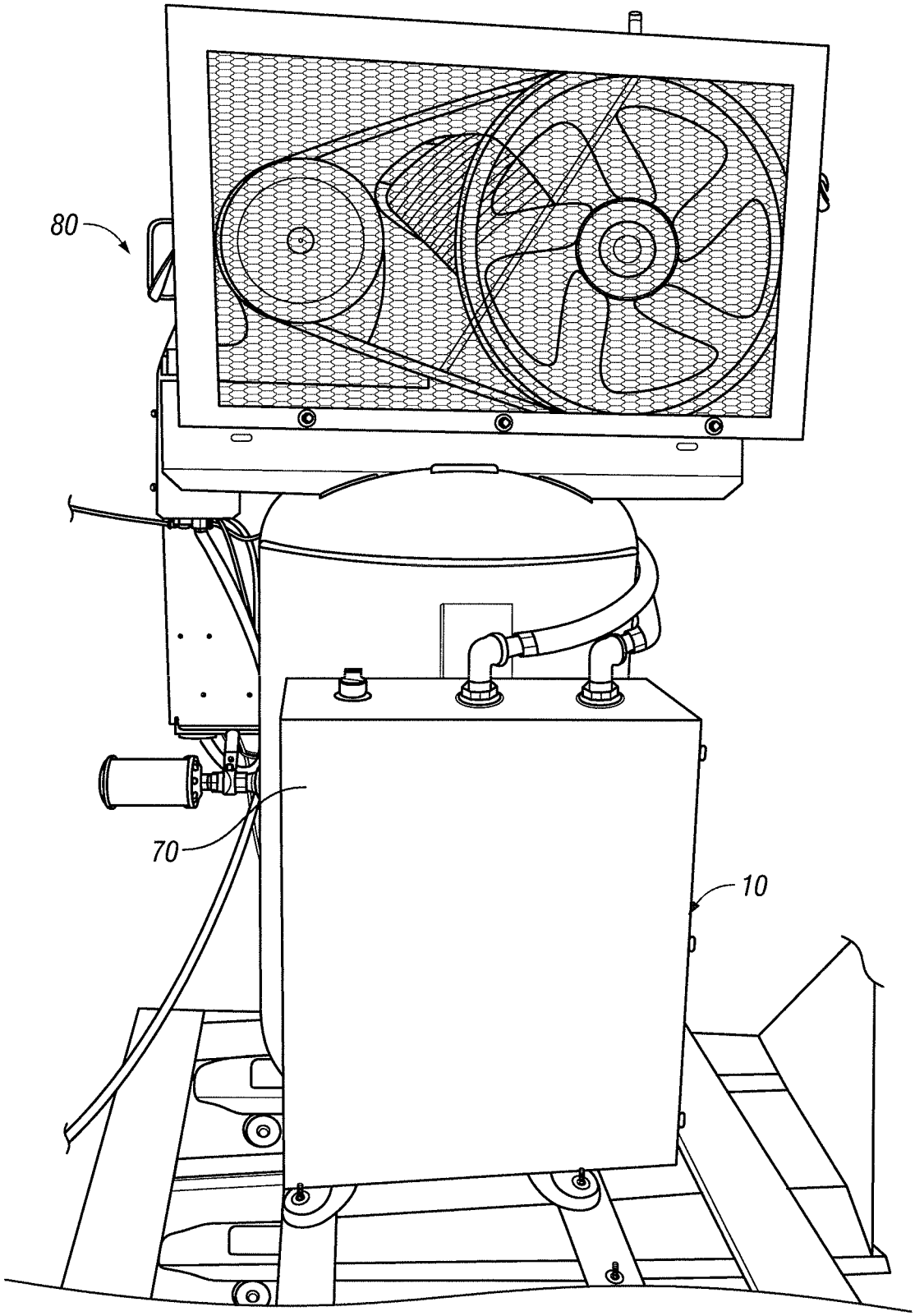
FIG. 7 is a rear view of the air compressor shown in FIG. 5.
Figure 8:
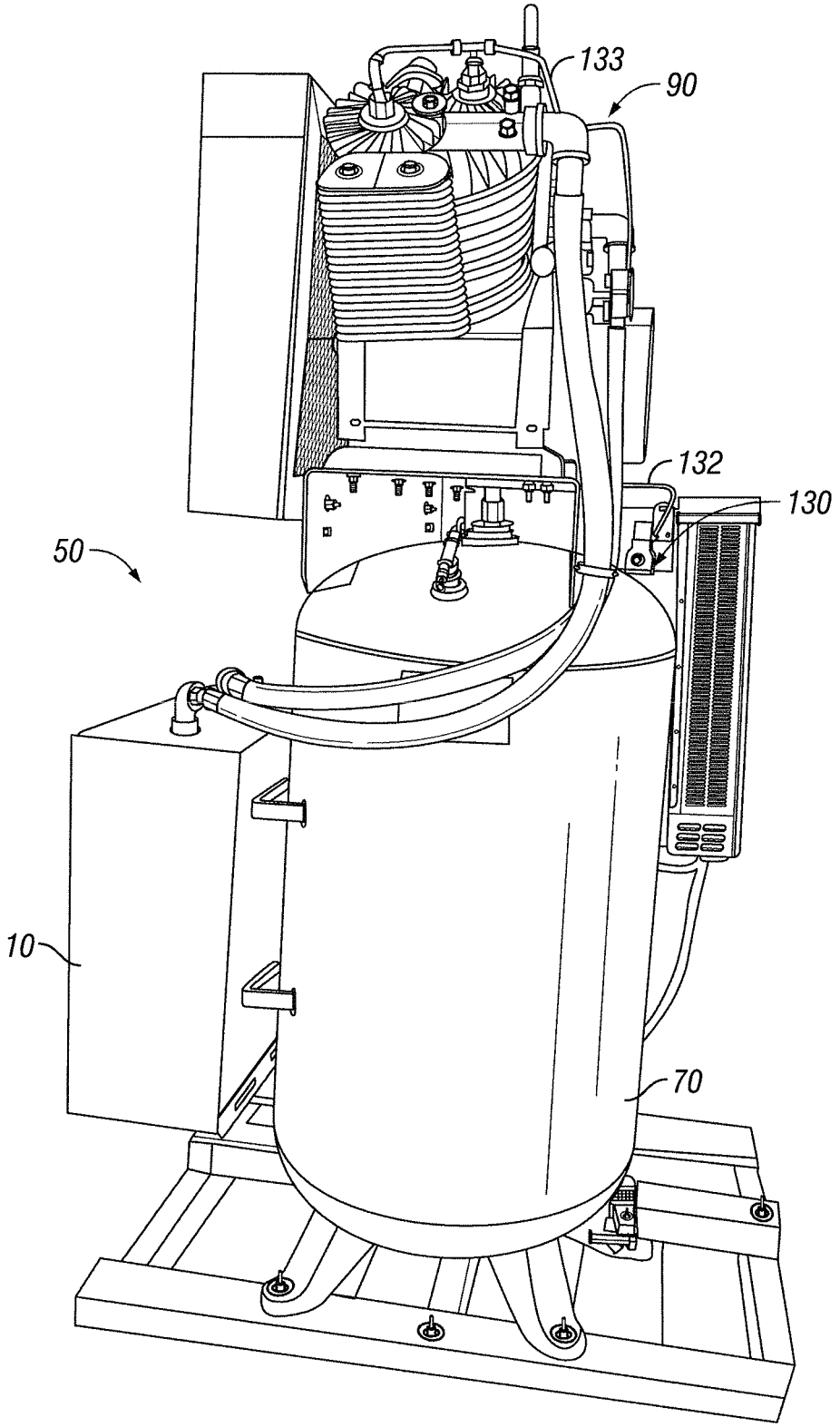
FIG. 8 is a left side view of the air compressor shown in FIG. 5.
Figure 9:
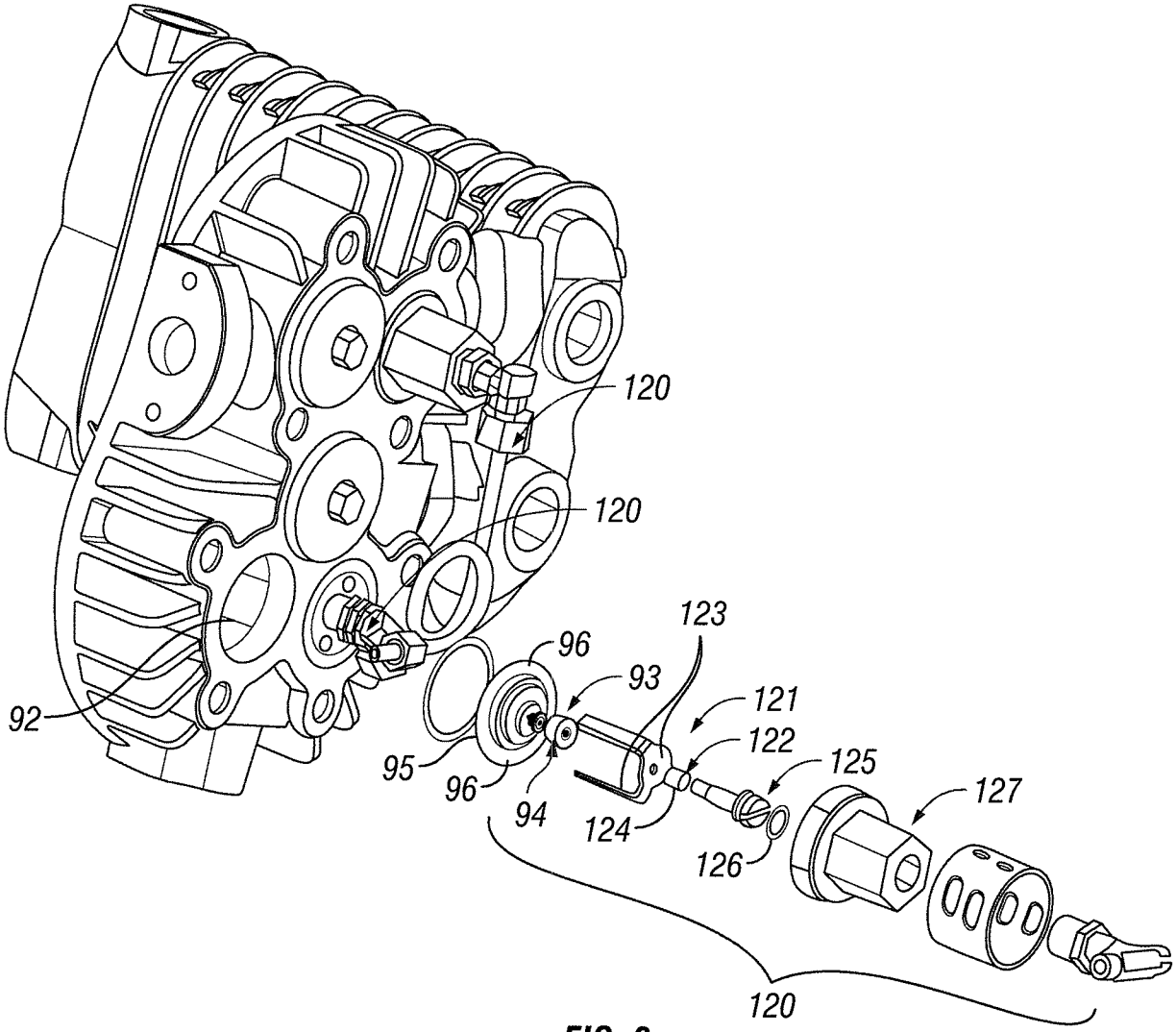
FIG. 9 is an exploded view of a head unloader that is a component of an air compressor according to one embodiment of the present invention.

FIG. 6 shows three head unloaders 120 (one of which is shown in an exploded view) that are components of air compressor 50 according to one embodiment of the present invention. In certain known air compressors, the system must work against the closing force of the air intake valve at the inlet end of the compressor while the system is coming up to speed. In the embodiment of the invention shown in FIG. 6, air compressor 50 includes an air intake 92, an air intake valve 93 having an opening 94 therein, and a valve seat 95 having openings 96 disposed about the periphery. Head unloader 120 includes a support 121 having an opening 122 and three legs 123, a spring 124, a plunger 125, an 0 ring 126 and an air cylinder 127. Legs 123 of support 121 engage openings 96 of valve seat 95. Plunger 125 extends through opening 122 of support 121 and engages opening 94 in air intake valve 93 to connect plunger 125 to air intake valve 93. Air compressor 50 is further provided with a solenoid 130 connected to a fitting 131 that communicates with tank 70 and tubing 132 having a first end connected to the opposite side of solenoid 130 from fitting 131. The opposite end of tubing 132 connects to tubing 133, which in turn connect to head unloaders 120 and communicates air to air cylinder 127. Prior to starting motor 80, solenoid 130 is closed. Upon starting motor 80, and before motor 80 comes up to speed, solenoid 13 opens, thereby communicating pressurized air from tank 70, through fitting 131, tubing 132 and tubing 133 to air cylinder 127. The pressurized air actuates air cylinder 127 and causes it to push plunger 125 against the force of spring 124, thereby depressing air intake valve 93 and holding it in the open position. In this manner, air can flow freely through air intake valve 94 as motor 80 comes up to speed. Thus, the system is not working against the force of air intake valve 94 during start-up, which reduces energy consumption. When motor 80 reaches the desired speed, programmable logic controller 60 closes solenoid 130, which in turn stops the flow of pressurized air to air cylinder 127. This causes plunger 125 to return to its initial position under the force of spring 124.

Figure 12:
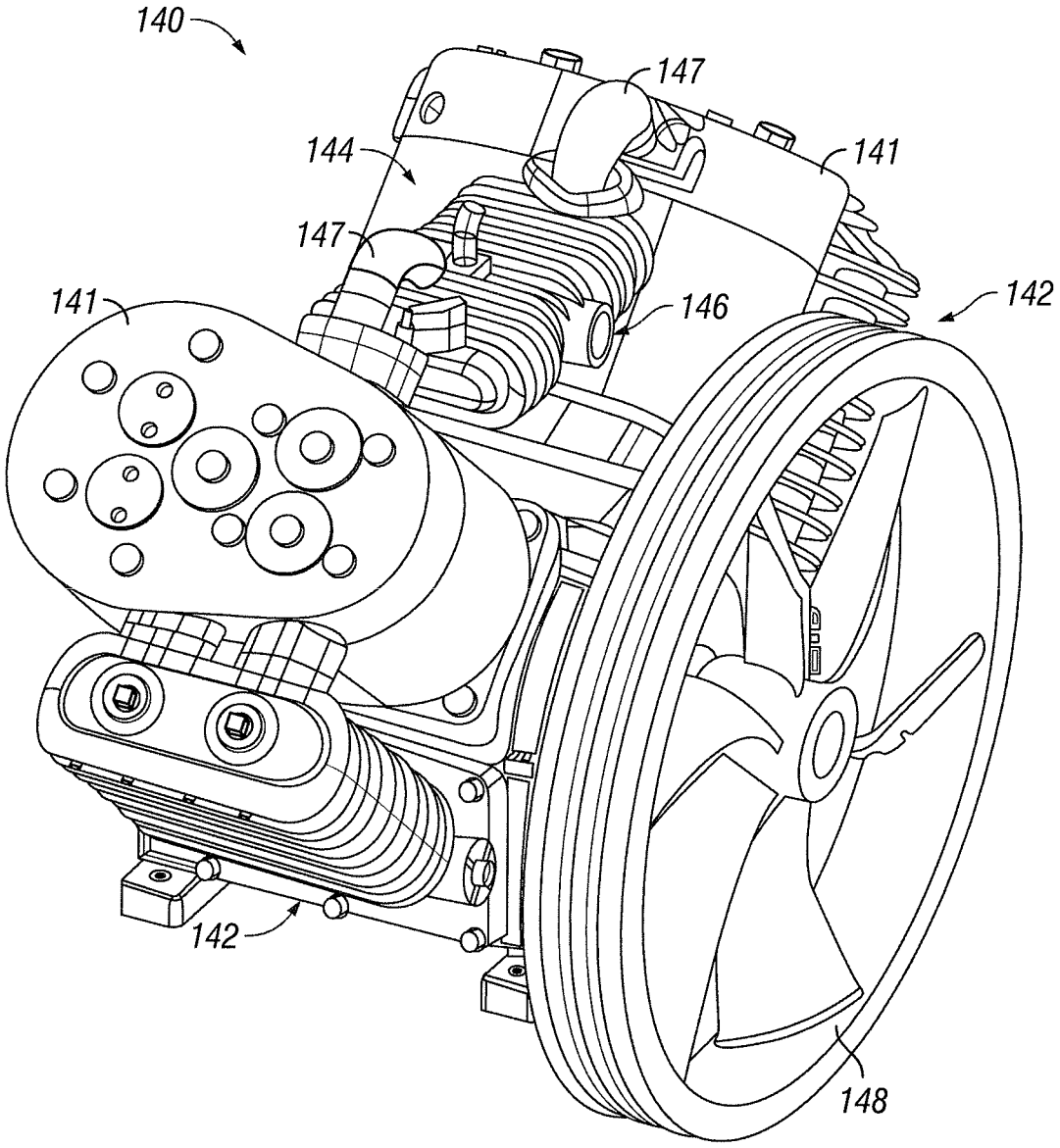
FIG. 12 is a perspective view of a cooling system that is a component of an air compressor according to another embodiment of the present invention.
Figure 13:
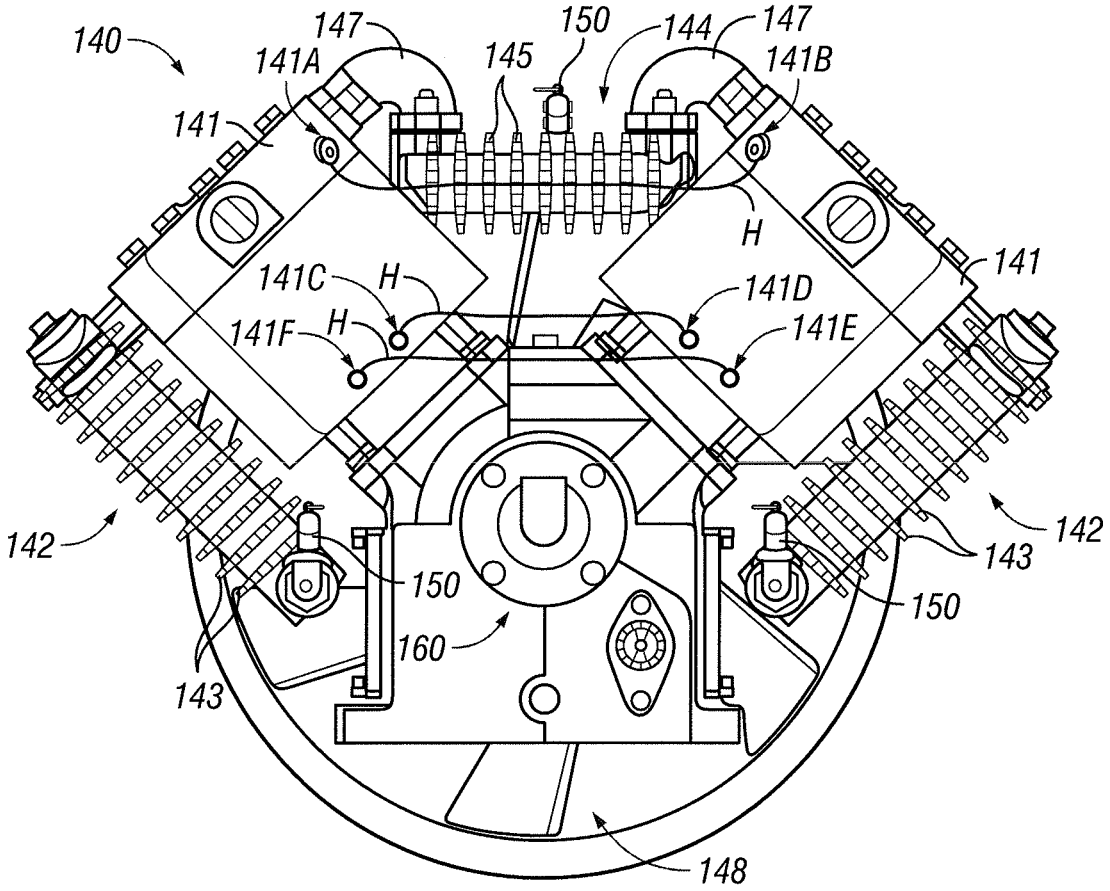
FIG. 13 is a front view of the cooling system shown in FIG. 12.

FIGS. 12 and 13 show a cooling system that is a component of an air compressor according to another embodiment of the present invention. In this embodiment, cooling system 140 includes cylinder heads 141 that enclose the air compressor pump, intercoolers 142 in the form of radiators having fins 143, a radiator 144 having fins 145 and a pressurized air outlet 146, exhaust tubes 147, a fan 148 for blowing air over intercoolers 142 and radiator 144, and pressure relief valves 150.

Cylinder heads 141 have a plurality of ports 141A-141F. In use, hoses H connect ports 141A and 141B, 141C and 141D, and 141E and 141F. Radiator 144 is internally configured as a two-part cooling device that includes separate passageways through which water (or another cooling fluid) and compressed air are circulated. In use, water is circulated through radiator 144, through channels in cylinder heads 141, and between cylinder heads 141 via ports 141A-141F and hoses H to cool the pump. Compressed air is also forced through radiator 144 via exhaust tubes 147 before exiting pressurized air outlet 146 to tank 70.

In certain embodiments of the invention, the pump is pressure lubricated by an oil pump 160. In certain embodiments, programmable logic controller 60 monitors the temperature of the lubricating oil during operation of air compressor 50 via an oil temperature sensor. Programmable logic controller 60 can be set to start a water cooling cycle only when the oil temperature reaches a preset start temperature and to stop the water cooling cycle when the oil temperature drops to or below a preset stop temperature.

Note that cooling system 140 substantially surrounds the pump. This configuration drastically reduces the audible noise produced by the valves, connecting rods, and other components of the pump. Use of cooling system 140 in addition to air compressor noise dampener 10, further reduces the noise produced by air compressor 50.

It should be understood, of course, that the foregoing relates to exemplary embodiments of the invention and that modifications may be made without departing from the spirit and scope of the invention as set forth in the following claims.

What is claimed is:

1. A reciprocating piston air compressor, including:

a tank for storing compressed air;

a reciprocating piston pump for compressing air and delivering it to the tank, the pump including an air intake and an air intake valve;

an electric motor for driving the pump;

a variable speed drive for operating the electric motor;

an outlet for delivering compressed air from the tank for use external to the tank;

a programmable logic controller for controlling operation of the air compressor; and a head unloader for maintaining the air intake valve in the open position during startup of the electric motor.

2. The reciprocating piston air compressor of claim 1, wherein the electric motor is a three-phase motor and the variable speed drive operates the electric motor on both single-phase and three-phase power.

3. The reciprocating piston compressor of claim 2, wherein the horse power rating of the variable speed drive exceeds the horse power rating of the electric motor.

4. The reciprocating piston air compressor of claim 1, wherein the head unloader includes a plunger for maintaining the air intake valve in the open position and an air cylinder for activating the plunger.

5. The reciprocating piston air compressor of claim 4, wherein the compressor further includes a fitting communicating with the tank, a solenoid connected to the fitting, the solenoid having an open position and a closed position, and tubing connected at one end to the solenoid and at another end to the head unloader to communicate air from the tank to the air cylinder to activate the air cylinder and depress the plunger when the solenoid is in the open position.

6. The reciprocating piston air compressor of claim 1, further including an aftercooler for cooling the compressed air after it exits the pump and before it enters the tank.

7. The reciprocating air compressor of claim 6, wherein the aftercooler includes a radiator and a fan.

8. The reciprocating piston air compressor of claim 1, further including a cooling system, the cooling system including:

a plurality of cylinder heads having channels therein through which a cooling fluid circulates; and a radiator, the radiator having a first section through which cooling water circulates and a second section through which compressed air circulates after exiting the pump and before entering the tank.

9. The reciprocating piston air compressor of claim 8, further including a plurality of ports in the cylinder heads and a plurality of hoses for circulating the cooling fluid from one cylinder head to another cylinder head.

10. A method of operating a reciprocating piston air compressor having a tank for storing compressed air, a reciprocating piston pump for compressing air and delivering it to the tank, an electric motor for driving the pump, a variable speed drive, an outlet for delivering compressed air from the tank for use external to the tank, and a programmable logic controller for controlling operation of the air compressor, the method including the steps of:

determining the level of air pressurization needed for a particular application;

utilizing the programmable logic controller to input an operating pressure range having a minimum operating pressure below the determined level, a maximum operating pressure at or above the determined level, and a buffer pressure that is lower than the maximum operating pressure;

starting the electric motor;

monitoring the level of air pressurization in the tank;

utilizing the variable speed drive to increase the operating speed of the electric motor when the level of air pressurization in the tank reaches the buffer pressure; and for each 1 psi of air pressurization level in the tank above the buffer pressure, decreasing the speed of the motor until the pressurization level in the tank reaches the maximum operating pressure.

11. A method of operating a reciprocating piston air compressor having a tank for storing compressed air, a reciprocating piston pump for compressing air and delivering it to the tank, an electric motor for driving the pump, an outlet for delivering compressed air from the tank for use external to the tank, a variable speed drive, and a programmable logic controller for controlling operation of the air compressor, the method including the steps of:

utilizing the programmable logic controller to input an operating pressure range having a minimum operating pressure and a maximum operating pressure;

utilizing the programmable logic controller to input a buffer pressure that is less than the maximum operating pressure;

monitoring the pressure in the tank; and utilizing the variable speed drive to decrease the speed of the electric motor when the pressure in the tank reaches the buffer pressure.

12. The method of claim 11, further including the step of decreasing the speed of the electric motor for each increase in pressure of 1 psi above the buffer pressure until the pressure in the tank reaches the maximum operating pressure.

13. A method of operating a reciprocating piston air compressor having a tank for storing compressed air, a reciprocating piston pump for compressing air and delivering it to the tank, the pump having an air inlet and an inlet valve moveable between and open position and a closed position, an electric motor for driving the pump, an outlet for delivering compressed air from the tank for use external to the tank, a variable speed drive, a head unloader, and a programmable logic controller for controlling operation of the air compressor, the method including the step of:

utilizing the programmable logic controller to control the head unloader to hold the air intake valve in the open position during startup of the electric motor;

utilizing the programmable logic controller to monitor the operating speed of the electric motor; and utilizing the programmable logic controller to cause the head unloader to close the air intake valve when the operating speed of the electric motor reaches a desired speed.

* * * * *